US010343814B2

(12) United States Patent
Ziemer

(10) Patent No.: US 10,343,814 B2
(45) Date of Patent: Jul. 9, 2019

(54) MOUNTING BRACE ASSEMBLY FOR TRANSPORTING PRODUCTS AND METHOD FOR USING

(71) Applicant: Crenlo Cab Products, Inc., Rochester, MN (US)

(72) Inventor: Eric John Ziemer, Pine Island, MN (US)

(73) Assignee: Crenlo Cab Products, Inc., Rochester, MN (US)

( * ) Notice: Subject to any disclaimer, the term of this patent is extended or adjusted under 35 U.S.C. 154(b) by 0 days.

(21) Appl. No.: 15/880,100

(22) Filed: Jan. 25, 2018

(65) Prior Publication Data

US 2018/0208358 A1 Jul. 26, 2018

Related U.S. Application Data

(60) Provisional application No. 62/450,701, filed on Jan. 26, 2017.

(51) Int. Cl.

| | |
|---|---|
| ***B65D 19/00*** | (2006.01) |
| ***B65D 19/42*** | (2006.01) |
| ***B65D 61/00*** | (2006.01) |
| ***B65D 19/40*** | (2006.01) |

(52) U.S. Cl.

CPC ..... *B65D 19/0095* (2013.01); *B65D 19/40* (2013.01); *B65D 19/42* (2013.01); *B65D 61/00* (2013.01); *B65D 2519/00024* (2013.01); *B65D 2519/00034* (2013.01); *B65D 2519/00059* (2013.01); *B65D 2519/00069* (2013.01); *B65D 2519/00273* (2013.01); *B65D 2519/00293* (2013.01); *B65D 2519/00323* (2013.01); *B65D 2519/00761* (2013.01); *B65D 2519/00815* (2013.01)

(58) Field of Classification Search

CPC ..... B65D 19/40; B65D 2519/00815; B65D 2519/00761; B65D 61/00

USPC ..... 108/55.5, 55.3, 55.1, 54.1, 56.3, 51.11; 206/386, 599, 600, 598

See application file for complete search history.

(56) References Cited

U.S. PATENT DOCUMENTS

| | | | | |
|---|---|---|---|---|
| 2,942,827 A * | 6/1960 | Edson | B65D 19/0028 | 108/54.1 |
| 3,493,128 A * | 2/1970 | Silvert | B65G 49/062 | 108/53.1 |
| 3,541,977 A * | 11/1970 | Waldman | B65D 19/0026 | 108/53.1 |
| 3,567,068 A * | 3/1971 | Carfizzi | B65D 19/40 | 108/56.3 |
| 3,695,187 A * | 10/1972 | Weiss | B65D 19/0095 | 108/54.1 |

(Continued)

*Primary Examiner* — Jose V Chen

(74) *Attorney, Agent, or Firm* — Nyemaster Goode, PC

(57) ABSTRACT

A mounting brace having a first tine receiving member and a second tine receiving member combined by an intermediate member. Each tine receiving member includes an opening adapted to receive a tine from a lift vehicle. The opening may be formed by an upper deck portion having a general vertically wall portion on each end. The tine receiving members and/or intermediate member are adapted to receive fasteners for removably attaching the mounting brace to the product so that the tines of a lift vehicle can be inserted into the openings in the tine receiving members to lift and transport the product.

17 Claims, 11 Drawing Sheets

(56) References Cited

U.S. PATENT DOCUMENTS 4,148,394 A * 4/1979 Bederman ..... B65D 71/0092 108/56.3
5,061,130 A * 10/1991 Gadow ..... B60P 7/10 410/104
5,297,485 A * 3/1994 Bond ..... B65D 19/44 108/54.1
5,644,991 A * 7/1997 Prevot ..... B65D 19/40 108/54.1
5,676,063 A * 10/1997 Wallace ..... B65D 19/0093 108/55.3
5,676,066 A * 10/1997 Cavalier ..... B65D 19/44 108/55.1
5,722,330 A * 3/1998 Staggers ..... B65D 19/44 108/55.3
5,735,219 A * 4/1998 Kirker ..... B23Q 7/14 108/54.1
5,842,424 A * 12/1998 Prevot ..... B65D 19/0026 108/54.1
6,668,734 B2 * 12/2003 Lucas ..... B65D 71/0088 108/51.11
6,811,131 B2 * 11/2004 Kuo ..... B25B 5/003 248/154
7,597,053 B2 * 10/2009 Muyskens ..... B65D 19/0002 108/51.11
7,726,247 B2 * 6/2010 Neland ..... E04H 6/225 108/55.1
7,766,348 B2 * 8/2010 McFarland ..... A47F 5/11 108/52.1
8,033,726 B2 * 10/2011 Mc Tavish ..... B65D 88/1687 383/121
8,261,674 B2 * 9/2012 Wathne ..... B63B 27/00 108/54.1
9,809,146 B2 * 11/2017 Myers ..... B60P 7/18
2014/0033956 A1 * 2/2014 Kelly ..... B62B 3/005 108/50.11
2018/0093796 A1 * 4/2018 Raninen ..... B62B 3/002
2018/0111717 A1 * 4/2018 Jiang ..... A47B 91/005
2018/0134445 A1 * 5/2018 Chezem ..... B65D 19/0095

* cited by examiner

MOUNTING BRACE ASSEMBLY FOR TRANSPORTING PRODUCTS AND METHOD FOR USING

This application is based upon U.S. Provisional Application Ser. No. 62/450,701 filed on Jan. 26, 2017, the complete disclosure of which is hereby expressly incorporated by this reference.

BACKGROUND

This invention relates to the field of devices, assemblies, kits, and methods used to help transport products. More specifically, the invention relates to one or more mounting braces adapted to be removably attached to a product to help transport the product with a lift vehicle.

Transporting a product involves moving it from one place to another place. Sometimes transporting a product involves shipping the product, which may involve loading the product into a container or onto a vehicle for transport, then unloading it when it arrives at its destination, then positioning it in its proper location at the destination. Transporting heavy and/or tall objects can be difficult, dangerous and time consuming. One way to transport these types of products requires securing the product to a shipping platform, which is often a disposable wooden pallet as shown in FIG. 1. The shipping platform is a raised platform having openings adapted to receive the tines of a pallet jack or forklift vehicle, which may be used to help move and load/unload the product. Some types of shipping platforms provide a means to attach protective packaging around the product, such as a crate or corrugate box as shown in FIG. 2. One problem with these traditional shipping platforms is that the product must be loaded on to and off of the platform during shipping. While the shipping platform provides useful functions, it may be difficult and dangerous to load/unload the product onto/from the platform, especially if the product has wheels, as is often the case with electrical enclosures. In particular, electrical enclosures have a relatively large aspect ratio of height to footprint and therefore are prone to tipping when trying to traverse the gap between the deck of the platform and the ground.

One solution for loading/unloading a product onto/from a shipping platform includes a ramp (shown in FIG. 2) positioned adjacent to the shipping platform. The ramp allows the product to roll off the pallet onto its wheels or casters after packaging constraints are removed. In the case of products such as electrical enclosures or data center racks, the center of gravity (CG) must be carefully considered so that the ramp angle is not so steep that it causes a tipping hazard. Care must also be taken to control the acceleration when the enclosure is rolled down the ramp. This may require several people or complex equipment especially since modern populated electrical enclosures may weigh thousands of pounds. In addition to dangers of using ramps, ramps also consume excess shipping space and weight within the packaging.

Another drawback to traditional shipping platforms is that they are typically made of wood. Some types of laminated wood materials are predictable and can be employed to high weight capacities, however, these types of materials are often very expensive. Natural wood materials are cheaper, but their weight capacity and performance is difficult to predict due to the high variability of the raw materials. Another problem with wood shipping platforms is that they usually can only be used one time because they become damaged as the product is secured then removed, especially when certain types of fasteners are used to secure the product to the platform. Typical pallets, skids, and crates are non-returnable and become a disposable cost of the product life cycle. Disposing of the pallets is often an additional cost to the end user. Shipping wood ramps and pallets also requires special products for certain import/export restrictions and are therefore subject to extra labeling and paperwork. Further, using wooden shipping platform materials tends to be wasteful due to limitations of board size and the commodity nature of the pallets not being sized correctly for a particular industry, market, or product. Generally speaking, this drives users to choose an oversized pallet that takes up more square footage during transit than required. This additional square footage impacts the cost of shipping and storage.

There is therefore a need for a device which overcomes these and other drawbacks in existing shipping technology.

SUMMARY

One aspect of the invention includes a device for helping to transport tall or heavy products. The device includes a mounting brace adapted to be removably attached to the product. The mounting brace comprises a first tine receiving member and a second tine receiving member. The first and second tine receiving members are combined by an intermediate member which provides a predetermined distance between the tine receiving members. The intermediate member may include a tray portion extending at least partially between the tine receiving members to help surround and protect the wheels of the product (if the product has wheels). In one embodiment the distance between the tine receiving members is about the width of the product. Each tine receiving member includes an opening adapted to receive a fork or tine from a forklift, pallet jack, or other similar device (collectively, a "lift vehicle"). The opening may be formed by an upper deck portion having a general vertically wall portion on each end. In one embodiment the distance between the openings in the tine receiving members is the distance between the tines on the lift vehicle. The tine receiving members and/or intermediate member includes fasteners such as bolts or screws (or openings adapted to receive fasteners) for removably attaching the mounting brace to the product.

In some embodiments, the tine receiving members include mounting features for attaching the brace to other objects or securing the brace/product inside a container or vehicle. In one embodiment, the mounting feature is a fastener adapted to secure one brace to an adjacent brace. The fastener may be secured to the deck of the mounting brace, or to any other suitable surface. The fastener may be employed to removably couple a first mounting brace supporting a first product to a second mounting brace supporting a second product. The first and second products/braces may be aligned side-by-side or front to back. The fastener may be a draw latch having a hook which is received by an opening in an adjacent mounting brace. Connecting multiple mounting braces side-to-side or front-to-back provides a large, interlocked, stable shipping base footprint and moves the center of gravity towards the center of the coupled mounting braces. This helps reduce the risk of the products rocking, tipping, or sliding around inside the trailer or shipping container; which reduces damage and reliance on other stabilizing solutions such as shipping air bags and shipping bars.

In some embodiments, the mounting brace device may be manufactured from metal or plastic. The use of non-organic materials such as metal and plastic enable more accurate numerical analysis to predict repeatable behavior over a large range of shock and vibration profiles which could not be achieved with such accuracy if wood is employed. Some embodiments are preconfigured with mounting features for attaching a wide variety of shock and vibration isolators including: rubber mounts, wire rope isolators, and shipping doughnuts. The metallic or plastic properties of the mounting brace makes the tie down and vibration isolation features re-usable, as opposed to wood screws which typically allow only one-time use.

Another aspect of the invention includes an assembly for transporting a product. The assembly comprises a first mounting brace device having a first tine receiving member and a second tine receiving member. The tine receiving members are combined by an intermediate member and each include an opening adapted to receive a tine from a lift vehicle. At least one of the first tine receiving member, the second tine receiving member, and the intermediate member are adapted to be removably attached to a first portion of the product. The assembly further comprises a second mounting brace device having a first tine receiving member and a second tine receiving member. The tine receiving members are combined by an intermediate member and each include an opening adapted to receive a tine from the lift vehicle. At least one of the first tine receiving member, the second tine receiving member, and the intermediate member are adapted to be removably attached to a second portion of the product. The embodiment may further include a third mounting brace device and a fourth mounting brace device each having a first tine receiving member and a second tine receiving member. The tine receiving members are combined by an intermediate member and each include an opening adapted to receive a tine from the lift vehicle. At least one of the first tine receiving member, the second tine receiving member, and the intermediate member are adapted to be removably attached to a second product; wherein the first mounting brace and the third mounting brace are adapted to be removably attached by a fastener.

Another aspect of the invention includes a kit or an assembly having a first mounting brace and a second mounting brace, each mounting brace adapted to be removably attached to a different portion of the product. Each of the mounting braces includes a first opening and a second opening adapted to receive a tine from a lift vehicle. The mounting braces may be attached to the product so that each of the respective first openings align and are adapted to receive a single tine and each of the respective second openings align and are adapted to receive a single tine. In this manner each tine of the lift vehicle extends between the first mounting brace and the second mounting brace, which means the tines extend under the entire length of the product in embodiments where the first mounting brace is attached to a first end of the product and the second mounting brace is attached to a second end of the product. In one embodiment, the two dimensional area of the first and second mounting braces is smaller than the product footprint area.

Another aspect of the invention includes a method for using any of the devices or assemblies described above. The method includes lifting the product off of the ground by any suitable means so that the mounting braces can be attached to the underside of the product. The product may be lifted a short distance off of the ground by any suitable lift vehicle. The mounting braces are attached to a structural load bearing section of the product with removable fasteners such as bolts or screws. The product is lowered to the ground so the mounting braces support the load of the product with the load on the frame of the product and the anchor points rather than the wheels (if the product has wheels). The tines of a lift vehicle are inserted into the openings in the mounting braces to lift the braces and product off of the ground and transport the product to its desired location, which may be in a container, truck, or train car. Mounting features on one or both mounting braces may be used to help secure the braces during transportation. Upon arrival at its destination, the product is unloaded by inserting the tines of a lift vehicle into the openings and transporting the braces/product to a desired location, then the assembly is lowered to the ground and the tines are removed from the openings in the mounting braces. At its desired location the product is again lifted off of the ground by a means which does not using the mounting braces so that the braces can be removed from the product. If a lift vehicle is used, it is used without inserting the tines into the openings in the braces since the weight must be off of the braces in order to remove them from the product. Once the weight is off the braces, the mounting braces are removed from the product by removing the removable fasteners and the braces are set aside. The product is then lowered to the floor/ground and onto its wheels (if it has wheels). In products such as electrical enclosures with standard width but varying depths and/or heights the same braces can be used to ship a large variety of products. The braces have a small footprint when removed since they do not extend under the entire product and their durability allows them to be reused on different products shipped in the future.

The device, kit, and assembly described above provides all the requirements of a traditional shipping platform while avoiding the many pitfalls. It is composed of multiple pieces, so that it is easy to load and unload the product. This invention supports products, such as those shipped with caster wheels, while protecting the casters from bearing the load or shipping damage. In the case of electrical enclosures, the load may be directed to the typical load anchor or seismic anchor points of the product. Further, the invention eliminates the need for a ramp and thus helps to avoid the tipping danger that they entail while saving shipping space and reducing weight.

DETAILED DESCRIPTION

The invention includes a device for helping to transport tall or heavy products 11. As used herein, the product 11 being transported may include its packaging. In other words, when the disclosure references attaching components on the invention to the "product", that reference may also include the product's packaging in instances where the product includes packaging. Further, as used herein, "removably attached" means that the components are attached but capable of being separated without destroying the integrity of either component. It should be noted that words used in this specification such as upper, lower, top, side, and bottom, are relative to the device as it is shown in FIG. 3A.

Figure 1:
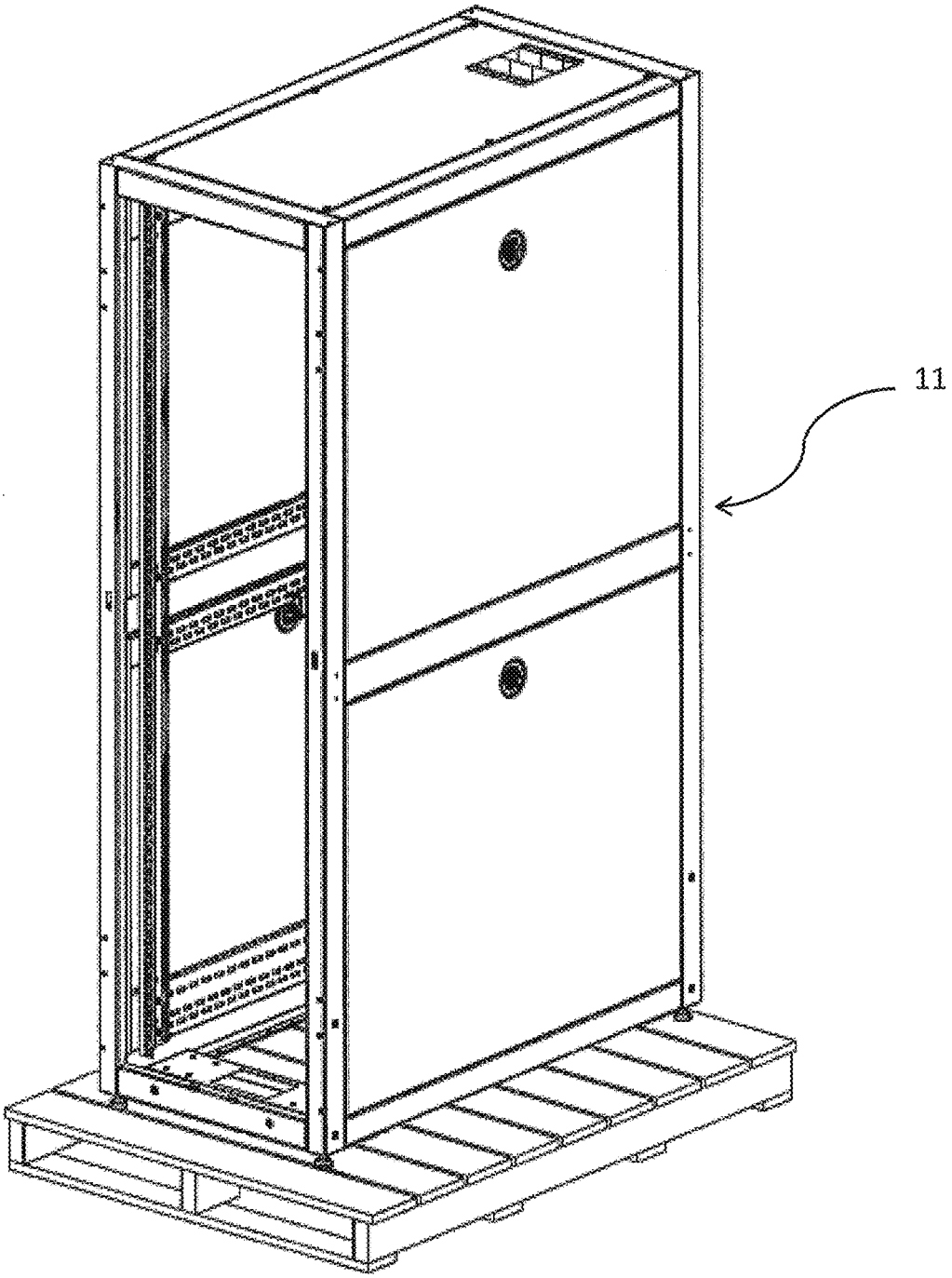
Figure 1 (Prior Art)
FIG. 1 is a perspective view of a prior art wooden pallet shipping platform attached to a product.
Figure 2:
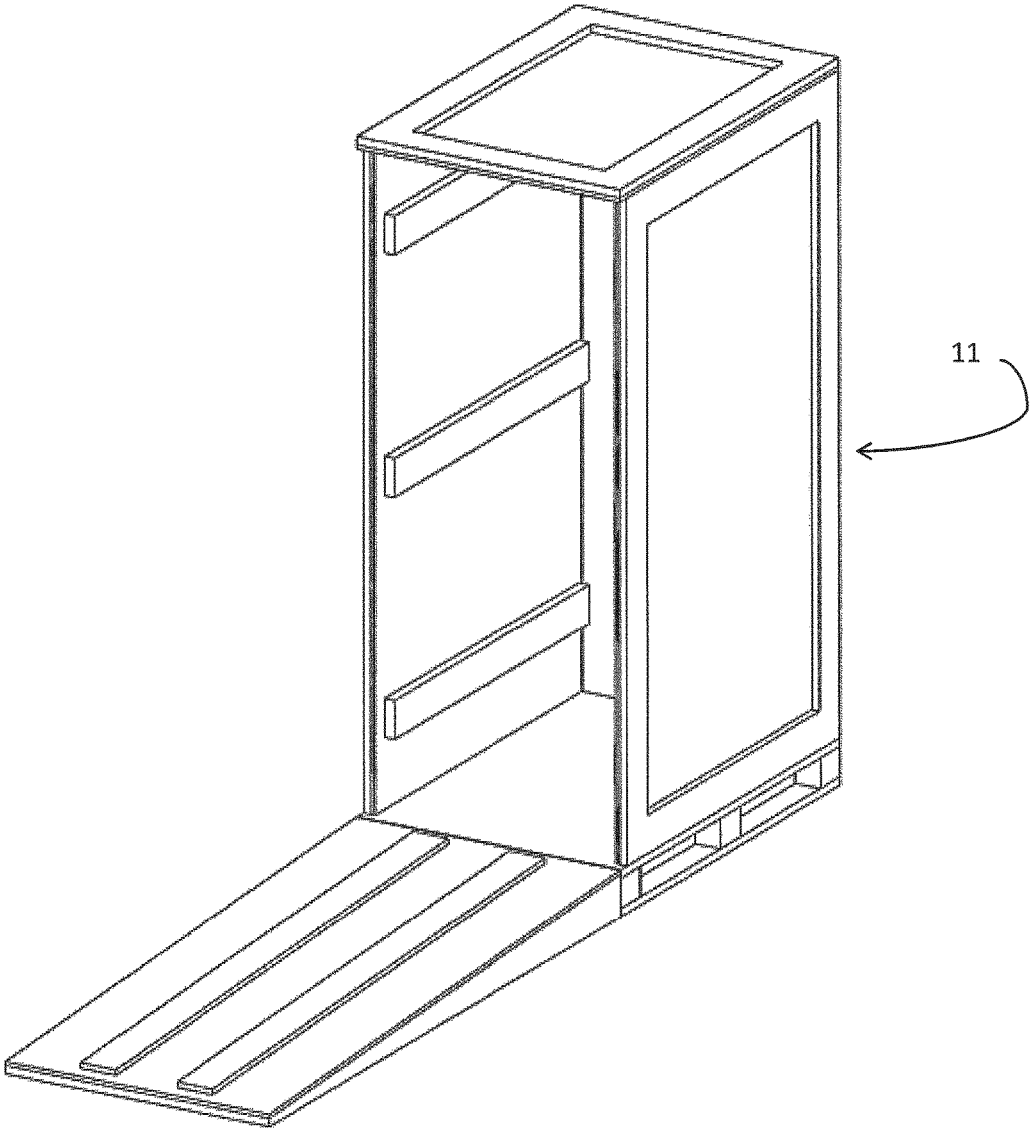
Figure 2 (Prior Art)
FIG. 2 is a perspective view of a prior art shipping platform having a protective crate enclosure and a ramp.
Figure 4:
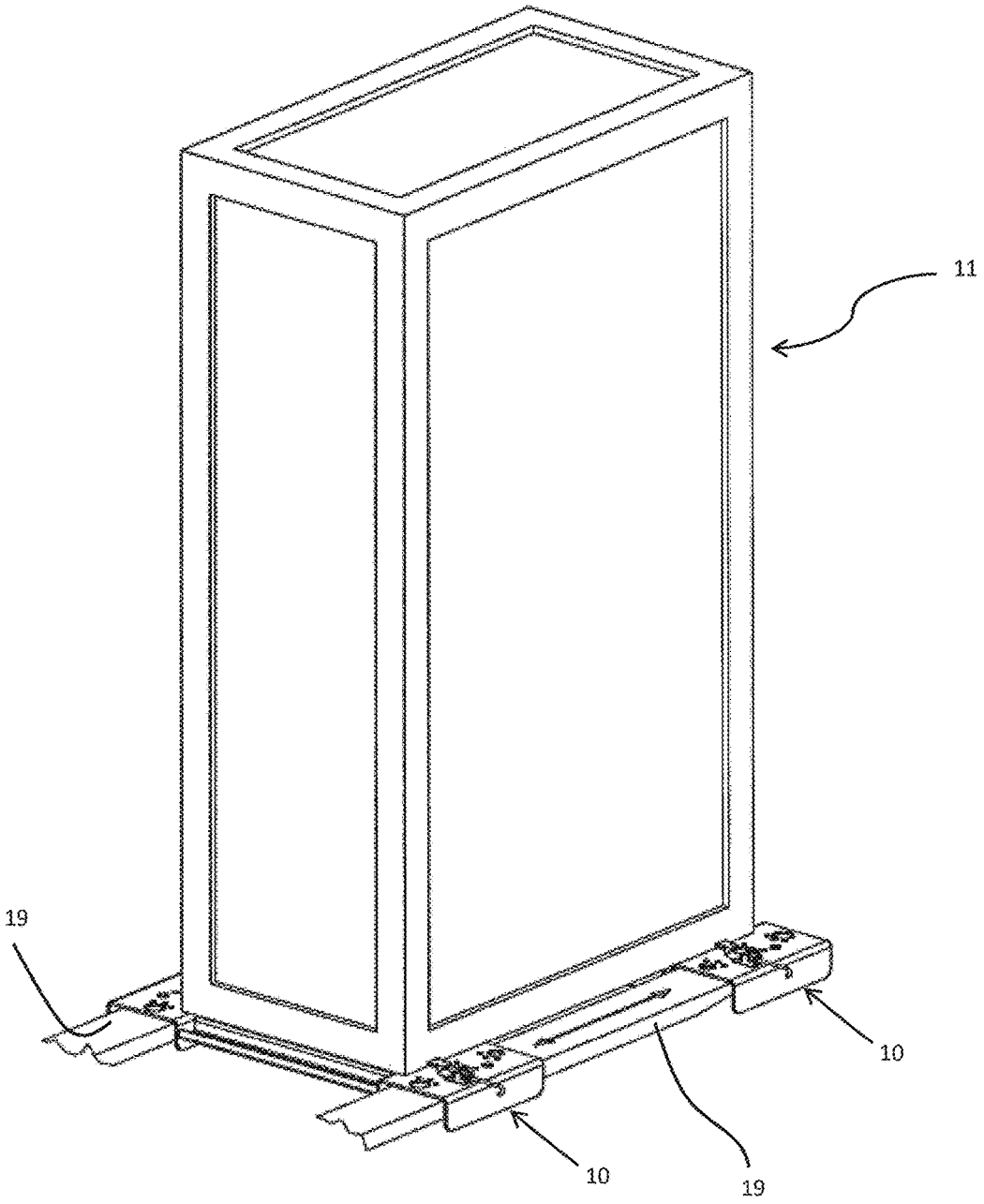
FIG. 4 is a perspective view of an embodiment showing the tines of a lift vehicle being received into the openings in the mounting braces.
Figure 5:
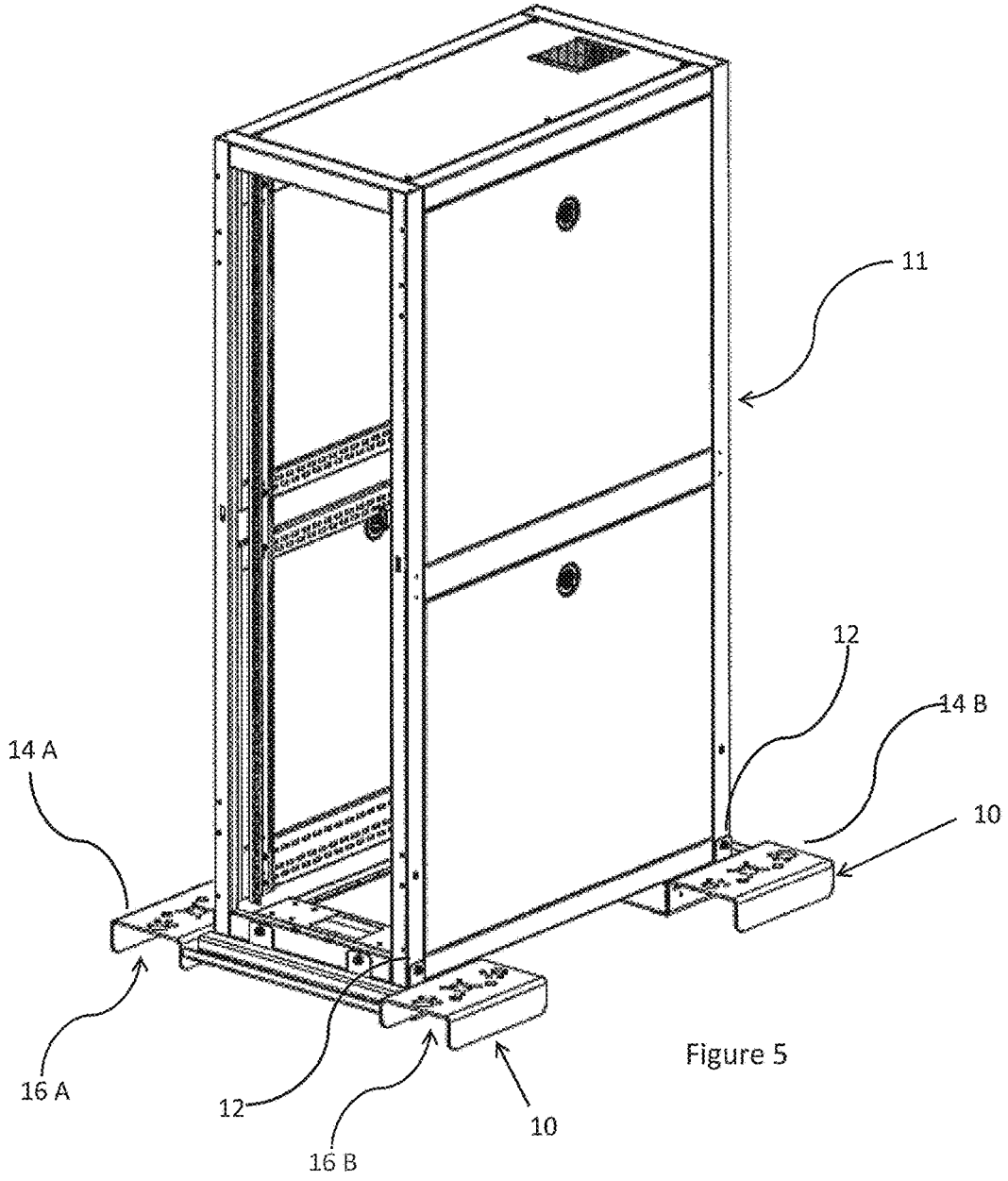
FIG. 5 is a perspective view of an embodiment showing two mounting braces attached to a product.

FIGS. 1 and 2 show examples of shipping platform devices which have been used in the past to ship products 11. These devices and their drawbacks are discussed in more detail above. FIGS. 3A and 3B show an embodiment of the mounting brace 10 device adapted to be attached to the product 11. The mounting brace 10 comprises a first tine receiving member 14A and a second tine receiving member 14B. The first and second tine receiving members 14A, 14B are combined by an intermediate member 30 to provide a predetermined distance between the tine receiving members 14A, 14B. In one embodiment the distance between the tine receiving members 14A, 14B is about the width of the product 11 as shown in FIGS. 4 and 5. Each tine receiving member 14A, 14B includes an opening 16A, 16B adapted to receive a fork or tine 19 from a forklift or pallet jack (collectively, a "lift vehicle"). In one embodiment the distance between the openings 16A, 16B in the tine receiving members 14A, 14B is about the distance between the tines 19 on the lift vehicle 23 as shown in FIG. 4. The tine receiving members 14A, 14B and/or intermediate member 30 are adapted to receive fastener 12 such as bolts or screws (or include openings adapted to receive fasteners 12) for removably attaching the mounting brace 10 device to the product 11.

In some embodiments the openings 16A, 16B in the tine receiving members 14A, 14B are formed by two generally vertical side walls 34A, 34B connected by a top portion referred to herein as a deck 32A, 32B. In one embodiment the openings 16A, 16B do not have front and rear walls thereby allowing the openings 16A, 16B to extend through the entire tine receiving members 14A, 14B as shown in FIG. 4. One or both of the decks 32A, 32B may comprise a plurality of mounting features such as openings, hooks, or fasteners. The mounting features may be used to attach packaging structures, such as a crate or corrugate box, which may surround and protect the product 11. The mounting features may also be used to attach the mounting brace 10 to a shipping container or trailer once the product 11 has been loaded inside such a space.

Figure 3A:
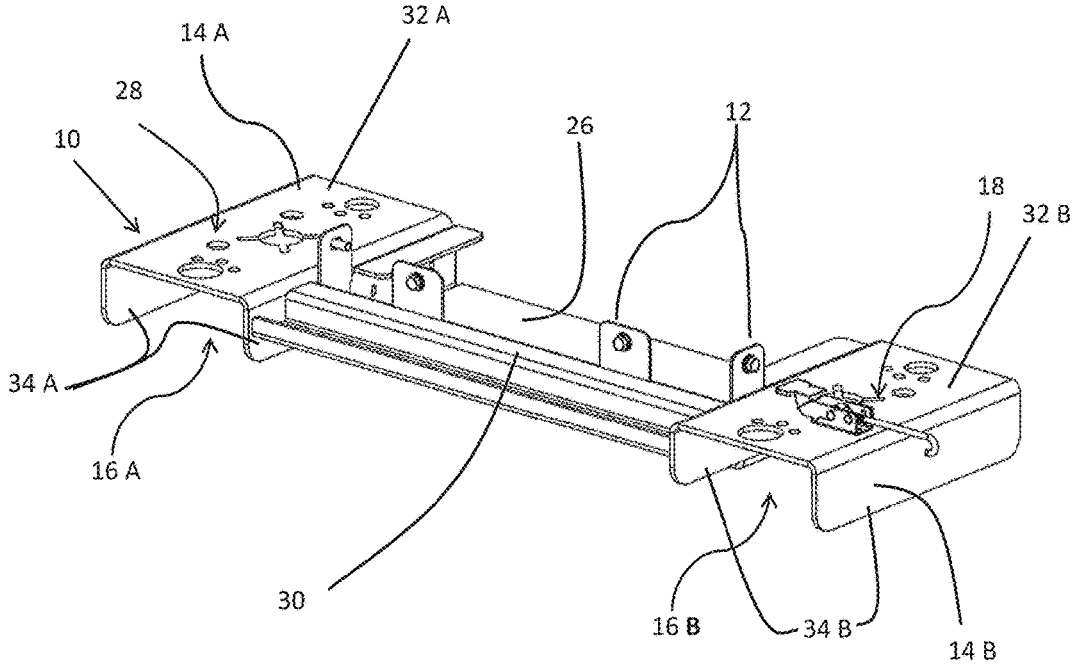
FIG. 3A is a perspective view of an embodiment showing a first side of a single mounting brace.
Figure 3B:
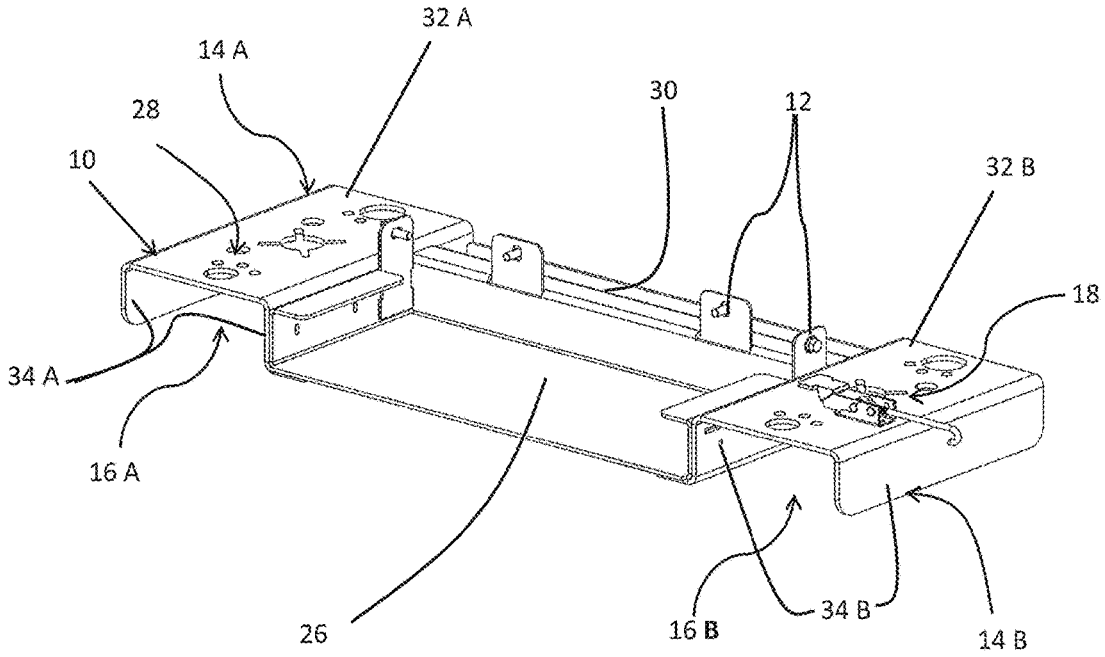
FIG. 3B is a perspective view of an embodiment showing a second side of a single mounting brace.
Figure 8:
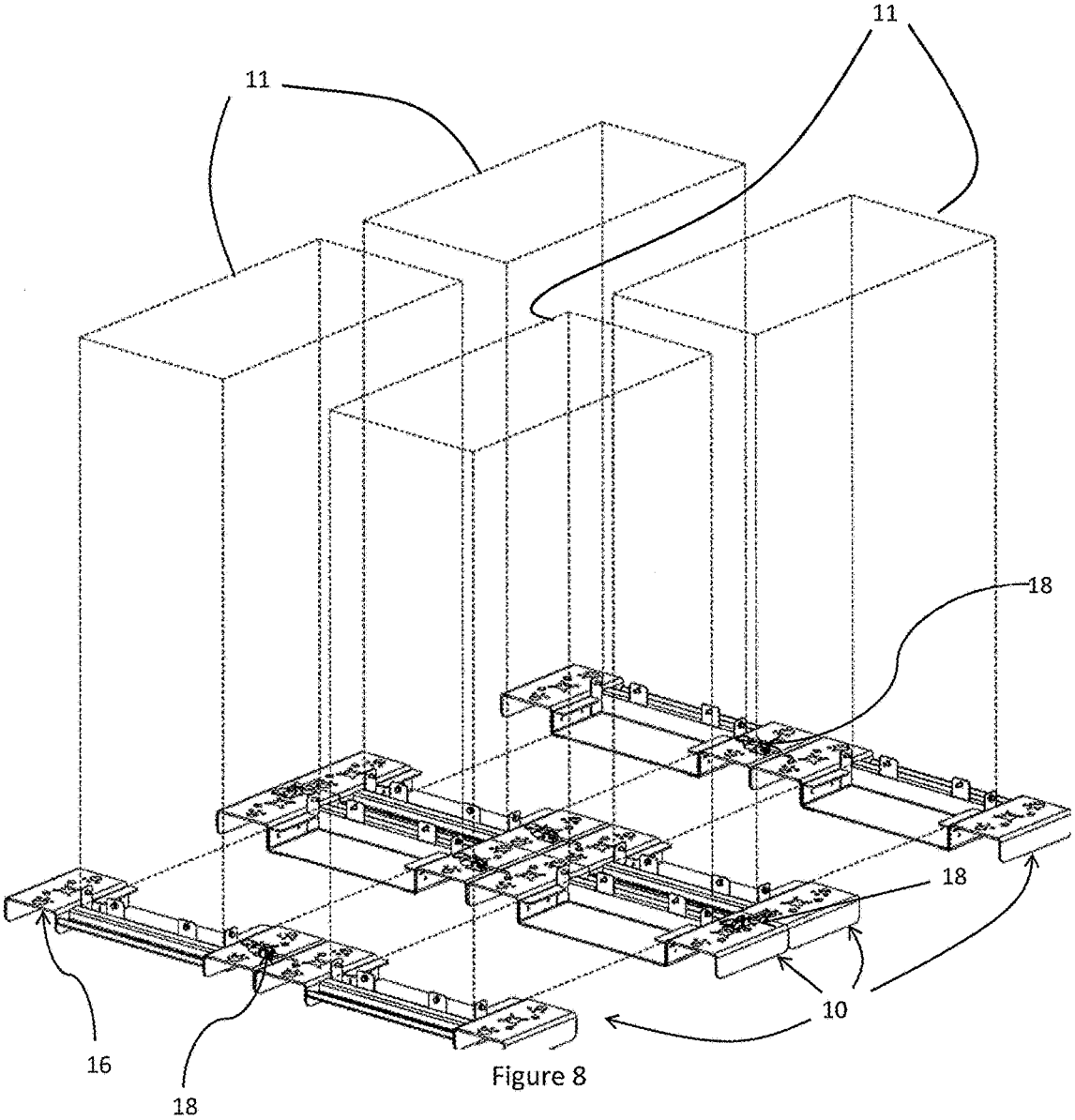
FIG. 8 is a perspective view showing an embodiment wherein a plurality of mounting braces are attached using fasteners.

As shown in FIGS. 3A, 3B, and 8, one or both of the tine receiving members 14A, 14B may include a mounting feature which is a fastener 18 for securing adjacent mounting braces 10 together. The fastener 18 may be secured to the deck 32A, 32B of the mounting brace 10, its side walls 34A, 34B, or any other suitable surface. The fastener 18 may be employed to removably attach a first mounting brace 10 supporting a first product 11 to a second mounting brace 10 supporting a second product 11 as shown in FIG. 8. As shown, the first and second braces 10/products 11 may be aligned side-by-side or front to back. The fastener 18 may be a draw latch having a hook which is received into an opening in an adjacent mounting brace 10 then tightened to secure the components together. Connecting multiple mounting braces 10 side-to-side or front to back provides a large, interlocked, stable shipping base footprint and moves the center of gravity towards the center of the coupled mounting braces 10/products 11.

Figure 10:
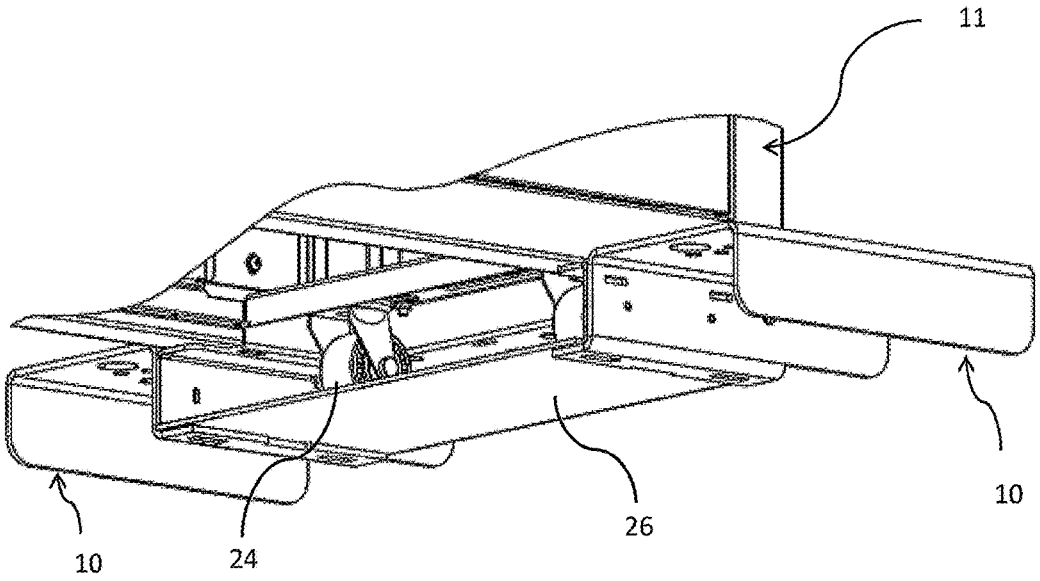
FIG. 10 is a perspective cutaway view of an embodiment showing the tray portion of the intermediate member used to protect the wheels of a product.

As shown best in FIGS. 3B and 10, some embodiments of the intermediate member 30 include one or more tray portions 26 between the first tine receiving member 14A and the second tine receiving member 14B. The one or more tray portion(s) 26 extend along a bottom portion of the mounting brace 10 so that it is near or touching the ground when the mounting brace 10 is placed on the ground. The tray portion 26 helps to at least partially enclose and protect the casters or wheels 24 of a product 11 as shown in FIG. 10 (if the product has casters or wheels 24). In some embodiments the casters or wheels 24 contact the tray portion 26 so that the weight of the product 11 rests on the tray 26 when the mounting brace 10 is on the ground. In other embodiments the casters or wheels 24 do not rest on the tray 26 so that the weight of the product 11 is transferred to the mounting brace 10 through other structural elements of the product 11.

Figure 9:
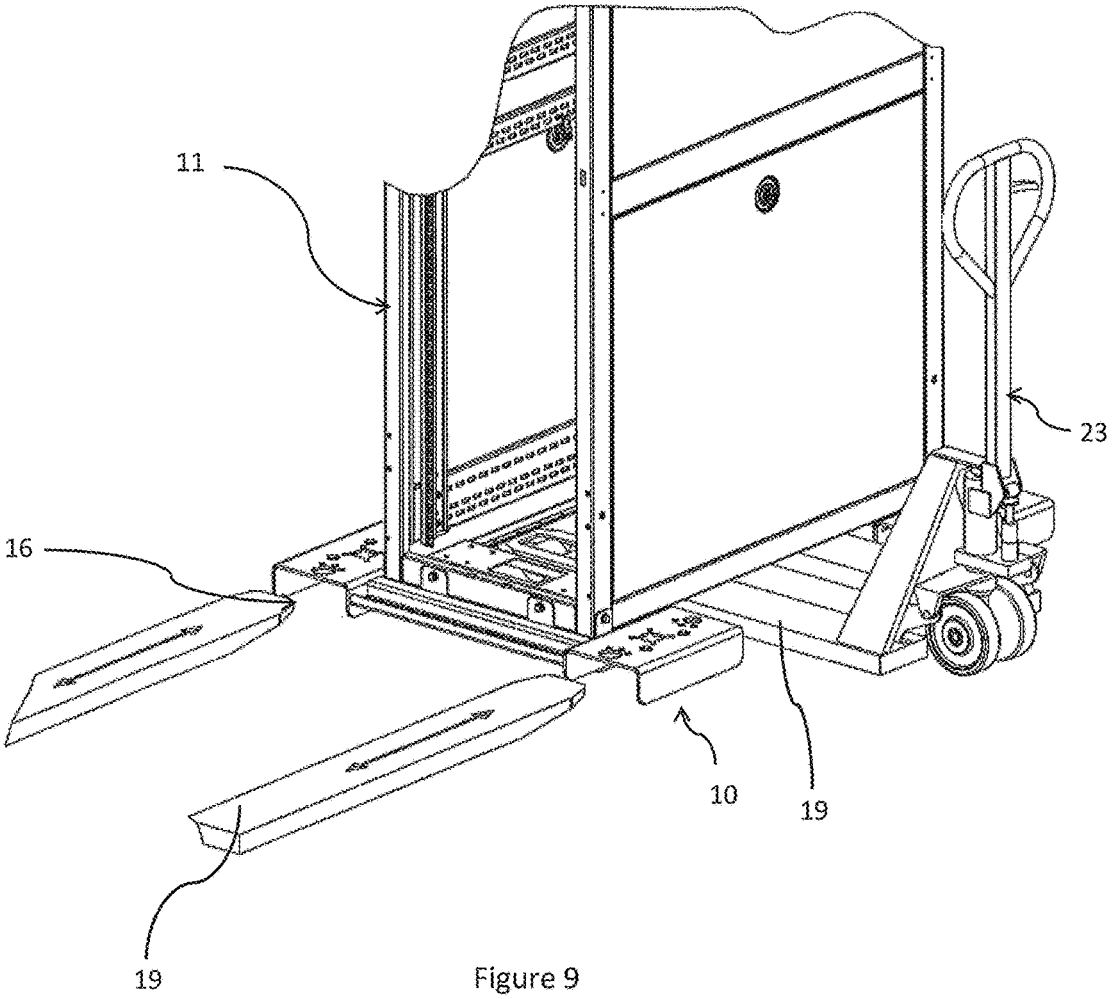
FIG. 9 is a perspective cutaway view of an embodiment showing a pallet jack being used to elevate the product to attach/remove the mounting braces from the product.

FIGS. 4, 5, and 9 show how multiple mounting braces 10 are attached to different portions of a product 11. The mounting braces 10 are spaced apart along the length of the product 11 in an effort to provide a larger foundation to help avoid tipping. Additionally, the space between the mounting braces 10 provides a space for the product 11 to receive the tines 19 of a lift vehicle 23 to lift the product 11 off of the ground while the braces 10 are attached and removed as shown in FIG. 9. In one embodiment a first mounting brace 10 is removably attached to a first end of a product 11 and a second mounting brace 10 adapted to be removably attached to a second end of the product 11. The mounting braces 10 may be attached to the product 11 so that each of the respective first openings 16A align and are adapted to receive a single tine 19 and each of the respective second openings 16B align and are adapted to receive a single tine 19. In this manner each tine 19 of the lift vehicle 23 extends through the opening 16A in the first mounting brace 10 and is received by the corresponding openings 16A in the second mounting brace 10 allowing the tines 19 extend under the entire length of the product 11 as shown in FIG. 4. In one embodiment, the two dimensional area of the first and second mounting braces 10 is smaller than the two dimensional product 11 footprint area.

In some embodiments, the mounting brace 10 is manufactured from metal or plastic. The use of non-organic materials such as metal and plastic enable more accurate numerical analysis to predict repeatable behavior over a large range of shock and vibration profiles which could not be achieved with such accuracy if wood is employed. Some embodiments are preconfigured with mounting points for attaching a wide variety of shock and vibration isolators including: rubber mounts, wire rope isolators, and shipping doughnuts. The metallic or plastic properties of the mounting brace 10 makes the tie down and vibration isolation features re-usable, as opposed to wood screws which typically allow only one-time use.

Figure 6A:
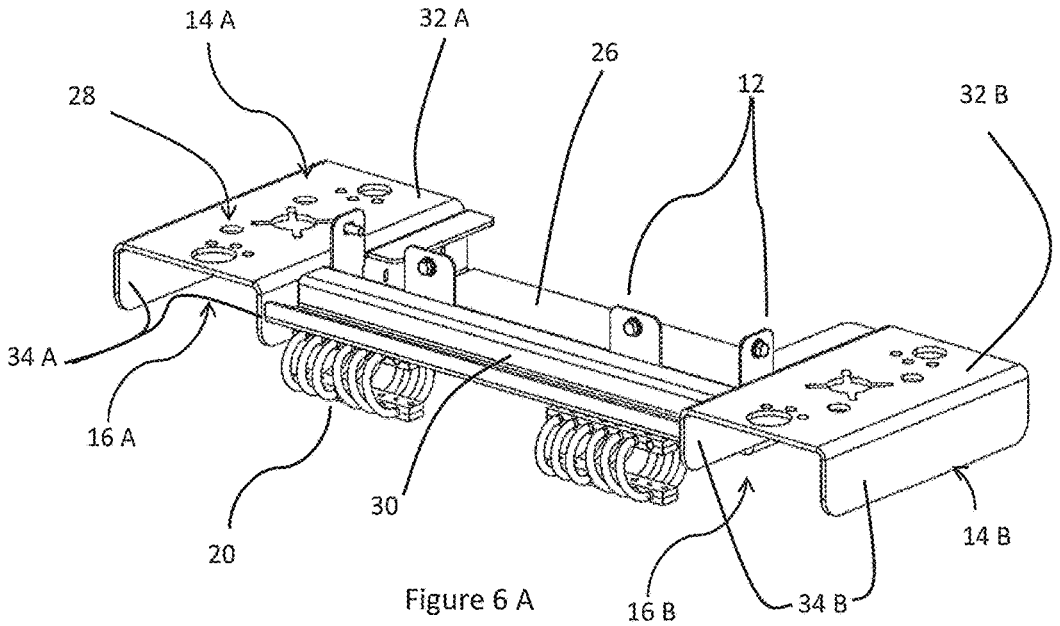
FIG. 6A is a perspective view of an embodiment showing a single mounting brace having a vibration isolator.
Figure 6B:
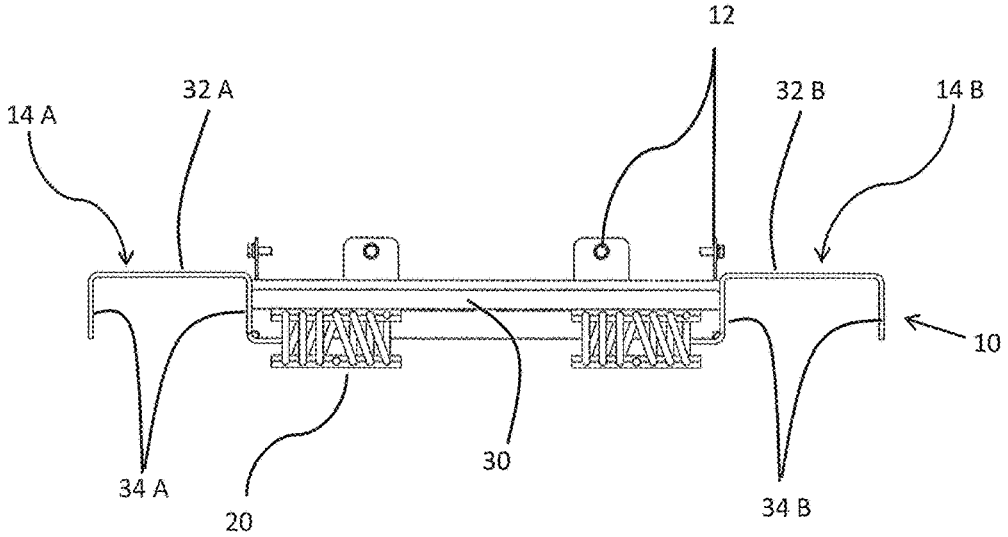
FIG. 6B is an end view of an embodiment showing a single mounting brace having a vibration isolator.
Figure 7A:
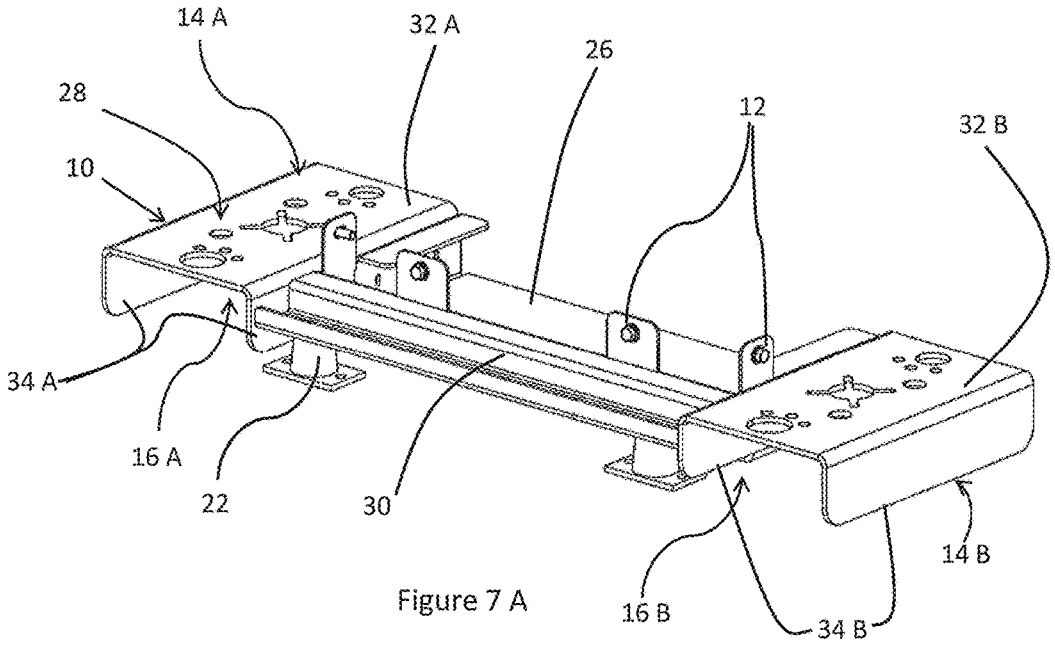
FIG. 7A is a perspective view of an embodiment showing a single mounting brace having a rubber isolation pad.
Figure 7B:
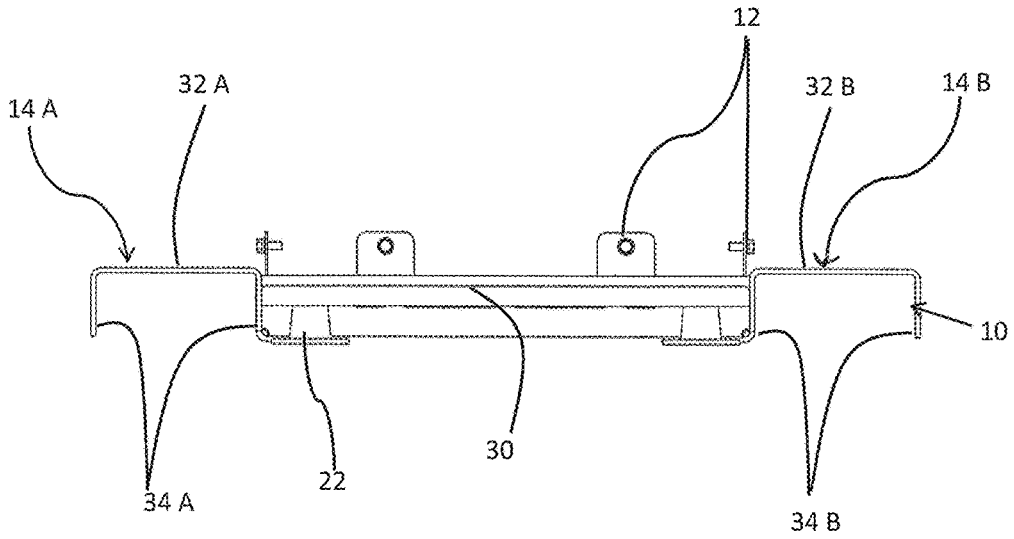
FIG. 7B is an end view of an embodiment showing a single mounting brace having a rubber isolation pad.

The braces can provide un-aided mounts, or can be equipped with shock and vibration absorbing components. FIGS. 6A and 6B show an embodiment wherein the mounting brace 10 includes a wire rope vibration isolator 20. FIGS. 7A and 7B show an embodiment of the mounting brace 10 having a rubber vibration isolators 22.

To use the mounting braces 10, the product 11 must first be lifted off of the ground so the mounting braces 10 can be attached to a lower portion of the product 11, preferably a structural load bearing section of the product 11. Depending on the weight of the product 11, a lift vehicle 23 may be used to help elevate the product 11 as the mounting braces 10 are being attached (FIG. 9). The mounting braces 10 have an area that is smaller than the area/footprint of the product 11. This allows the lift vehicle 23 to position its tines 19 under the product 11 without interfering with the attachment/removal of the mounting braces 10. The braces 10 may be attached by any suitable means. In one embodiment, the braces 10 are attached by removable fasteners 12, such as bolts or screws, to opposite ends of the bottom of the product 11 leaving an opening under the middle portion of the product 11 where there are no braces 10 as shown in FIGS. 5 and 9. If the product 10 has wheels 24, the mounting braces 10 are attached in such a manner that the load is transmitted to the frame of the product 11 and the anchor points rather than the wheels 24.

After the mounting braces 10 are attached, the product 11 is lowered to the ground, then the tines 19 of a lift vehicle 23 are inserted into the openings 16A, 16B in the mounting braces 10 to transport the product 11 to its desired location, which may be in a container, truck, or train car. Upon arrival at its destination, the product 11 is unloaded by inserting the tines 19 of a lift vehicle 23 into the openings 16A, 16B and lifting/moving the product 11 to its desired location, then the tines 19 are removed from the openings 16A, 16B in the mounting braces 10. At its desired location, and depending on the weight of the product 11, a lift vehicle 23 may be used to lift the product 11 off of the ground by inserting the tines 19 beneath the product 11 and between the braces 10 as shown in FIG. 9. Once the weight is off the braces 10, then the braces 10 are removed from the product 11 by removing the removable fasteners 12, and the braces 10 are set aside. The product 11 is then lowered to the floor/ground and onto its casters or wheels 24 (if it has casters or wheels). In products 11 such as electrical enclosures with standard width but varying depths and/or heights the same braces 10 can be used to ship a large variety of products 11. The braces 10 have a small footprint when removed since they do not extend under the entire product 11 and their durability allows them to be reused on different products 11 shipped in the future.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included with in the scope of the following claims.

What is claimed is as follows:

1. A mounting brace device for transporting a product, said device comprising:

a first tine receiving member and a second tine receiving member, said tine receiving members combined by an intermediate member;

wherein the first tine receiving member and the second tine receiving member each include an opening adapted to receive a tine from a lift vehicle;

wherein at least one of the first tine receiving member, the second tine receiving member, and the intermediate member are adapted to be removably attached to the product;

wherein the intermediate member further comprises a tray between the first tine receiving member and the second tine receiving member and the tray is adapted to be positioned beneath casters combined with the product.

2. The device of claim 1 wherein at least one of the first tine receiving member, the second tine receiving member, and the intermediate member have an opening for receiving a fastener to removably combine the mounting brace with the product.

3. The device of claim 1 wherein the opening in the first and send second tine receiving members is defined by a deck having a first side wall on one end and a second side wall on another end.

4. A mounting brace device for transporting a product, said device comprising:

a first tine receiving member and a second tine receiving member, said tine receiving members combined by an intermediate member;

wherein the first tine receiving member and the second tine receiving member each include an opening adapted to receive a tine from a lift vehicle;

wherein at least one of the first tine receiving member, the second tine receiving member, and the intermediate member are adapted to be removably attached to the product;

wherein at least one of the first tine receiving member and the second tine receiving member further include a mounting feature for securing the brace device to another object;

wherein the mounting feature is a fastener combined with the first tine receiving member, said fastener adapted to combine the first tine receiving member with another mounting brace.

5. The device of claim 4 wherein the fastener is a draw latch.

6. A mounting brace device for transporting a product, said device comprising:

a first tine receiving member and a second tine receiving member, said tine receiving members combined by an intermediate member;

wherein the first tine receiving member and the second tine receiving member each include an opening adapted to receive a tine from a lift vehicle;

wherein at least one of the first tine receiving member, the second tine receiving member, and the intermediate member are adapted to be removably attached to the product;

an opening in the second tine receiving member adapted to receive a fastener from another mounting brace.

7. The device of claim 1 further comprising a vibration isolator.

8. The device of claim 7 wherein the vibration isolator is one of a rubber mount and a wire rope isolator.

9. The device of claim 1 wherein the first tine receiving member, second tine receiving member, and intermediate member are made from metal or plastic.

10. An assembly for transporting a product, said assembly comprising:

a first mounting brace device having a first tine receiving member and a second tine receiving member, said tine receiving members combined by an intermediate member, wherein the first tine receiving member and the second tine receiving member each include an opening adapted to receive a tine from a lift vehicle, and wherein at least one of the first tine receiving member, the second tine receiving member, and the intermediate member are adapted to be removably attached with a first portion of the product;

a second mounting brace device having a first tine receiving member and a second tine receiving member, said tine receiving members combined by an intermediate member, wherein the first tine receiving member and the second tine receiving member each include an opening adapted to receive a tine from the lift vehicle, and wherein at least one of the first tine receiving member, the second tine receiving member, and the intermediate member are adapted to be removably attached with a second portion of the product.

11. The assembly of claim 10 further comprising a third mounting brace device and a fourth mounting brace device each having a first tine receiving member and a second tine receiving member, said tine receiving members combined by an intermediate member, wherein the first tine receiving member and the second tine receiving member each include an opening adapted to receive a tine from the lift vehicle, and wherein at least one of the first tine receiving member, the second tine receiving member, and the intermediate member are adapted to be removably attached to a second product;

wherein the first mounting brace and the third mounting brace are adapted to be removably attached by a fastener.

12. The assembly of claim 11 wherein the fastener is a draw latch.

13. The assembly of claim 10 wherein the first mounting brace and the second mounting brace together have a two dimensional area which is smaller than a two dimensional area of the product.

14. The device of claim 10 wherein the first tine receiving member, second tine receiving member, and intermediate member are made from metal or plastic.

15. A method for transporting a product, said method comprising:

providing a first mounting brace device and a second mounting brace device, each mounting brace device having a first tine receiving member and a second tine receiving member, said tine receiving members combined by an intermediate member, wherein the first tine receiving member and the second tine receiving member each include an opening adapted to receive a tine from a lift vehicle, and wherein at least one of the first tine receiving member, the second tine receiving member, and the intermediate member are adapted to be removably attached to the product;

lifting the product off of the ground;

attaching the first mounting brace to a first portion of the product;

attaching the second mounting brace to a second portion of the product;

lowering the product and transferring the weight of the product onto the first and second mounting braces;

inserting tines of a lift vehicle into the openings in the tine receiving members, lifting the product, and transporting the product to a desired location;

lowering the product at the desired location and removing the tines from the openings in the tine receiving members;

lifting the product to remove weight from the mounting braces and removing the first and second mounting braces from the product.

16. The method of claim 15 wherein the first mounting brace further comprises a fastener and the method further includes securing the first mounting brace to a third mounting brace.

17. The method of claim 15 wherein the first and second mounting braces are attached to a structural load bearing portion of the product with removable fasteners.

* * * * *